US012185855B2

(12) United States Patent
Whyte

(10) Patent No.: US 12,185,855 B2
(45) Date of Patent: Jan. 7, 2025

(54) ADJUSTABLE CLOTHES HANGER ASSEMBLY

(71) Applicant: Jack Whyte, Nashville, TN (US)

(72) Inventor: Jack Whyte, Nashville, TN (US)

( * ) Notice: Subject to any disclaimer, the term of this patent is extended or adjusted under 35 U.S.C. 154(b) by 0 days.

(21) Appl. No.: 18/199,794

(22) Filed: May 19, 2023

(65) Prior Publication Data

US 2024/0382027 A1 Nov. 21, 2024

(51) Int. Cl.
*A47G 25/44* (2006.01)
*A47G 25/30* (2006.01)
*A47G 25/48* (2006.01)

(52) U.S. Cl.
CPC ..... *A47G 25/441* (2013.01); *A47G 25/30* (2013.01); *A47G 25/48* (2013.01)

(58) Field of Classification Search
CPC ..... A47G 25/28; A47G 25/441
See application file for complete search history.

(56) References Cited

U.S. PATENT DOCUMENTS

| | | | | |
|---|---|---|---|---|
| 3,741,449 | A | 6/1973 | MacKenzie | |
| 3,874,572 | A | 4/1975 | McClenning | |
| 6,179,174 | B1 * | 1/2001 | Kandl | A47G 25/442 223/89 |
| 6,296,160 | B1 | 10/2001 | Murray | |
| 6,722,538 | B1 * | 4/2004 | Autry | A47G 25/441 223/89 |
| 6,964,360 | B2 | 11/2005 | Tubman | |
| 8,286,842 | B2 * | 10/2012 | Carey | A47G 25/4053 223/89 |
| 2010/0294815 | A1 * | 11/2010 | Carey | A47G 25/4053 223/94 |

FOREIGN PATENT DOCUMENTS

| | | | | |
|---|---|---|---|---|
| CN | 204351543 U | * | 5/2015 | |
| CN | 106724650 A | * | 5/2017 | |
| CN | 107432652 A | * | 12/2017 | A47G 25/30 |
| CN | 109805721 | | 5/2019 | |
| CN | 110037516 A | * | 7/2019 | |
| CN | 209528808 U | * | 10/2019 | |
| CN | 210138045 | | 3/2020 | |
| CN | 111588256 A | * | 8/2020 | |
| CN | 112336157 A | * | 2/2021 | A47G 25/28 |
| KR | 20220037203 A | * | 3/2022 | |

* cited by examiner

*Primary Examiner* — Shaun R Hurley

(57) ABSTRACT

An adjustable clothes hanger assembly includes an upper member that is longitudinally elongated. A hook is coupled to and extends upwardly from the upper member thereby facilitating the hook to be positioned on a closet rod. A lower member is elongated to have a length that is equal to a length of the upper member. A pair of curved tubes is provided and each of the curved tubes defines a U-shape to hang an article of clothing in the convention of a clothes hanger. Each of the curved tubes insertably receives the upper member and the lower member such that the upper member and the lower member and the pair of curved tubes defines an ovoid shape which has an adjustable length to accommodate various sizes of articles of clothing.

8 Claims, 8 Drawing Sheets

ADJUSTABLE CLOTHES HANGER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to clothes hanger devices and more particularly pertains to a new clothes hanger device for hanging clothes of various sizes. The device includes an upper member, a lower member and a pair of curved members that each slidably engages the upper member and the lower member to define a clothes hanger. The device includes a pair of cushions wrapped around a respective curved member and a pair of locks integrated into the upper member. Each of the locks releasably engages a respective curved member for retaining the curved members at a selected width to facilitate the clothes hanger to accommodate various sizes of clothing.

(2) Description of Related Art Including Information Disclosed Under 37 CFR 1.97 and 1.98

The prior art relates to clothes hanger devices including a clothes hanger that includes a variety of support frame formed into a loop and a pair of support rods extending laterally across the clothes hanger. The prior art discloses a clothes hanger that includes a central member and a pair of adjustable members that is slidably engaged to opposing ends of the central member for adjusting an overall length of the clothes hanger. The prior art discloses a clothes hanger that has a pair of shirt hooks integrated into a lower member of the clothes hanger.

BRIEF SUMMARY OF THE INVENTION

An embodiment of the disclosure meets the needs presented above by generally comprising an upper member that is longitudinally elongated. A hook is coupled to and extends upwardly from the upper member thereby facilitating the hook to be positioned on a closet rod. A lower member is elongated to have a length that is equal to a length of the upper member. A pair of curved tubes is provided and each of the curved tubes defines a U-shape to hang an article of clothing in the convention of a clothes hanger. Each of the curved tubes insertably receives the upper member and the lower member such that the upper member and the lower member and the pair of curved tubes defines an ovoid shape which has an adjustable length to accommodate various sizes of articles of clothing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
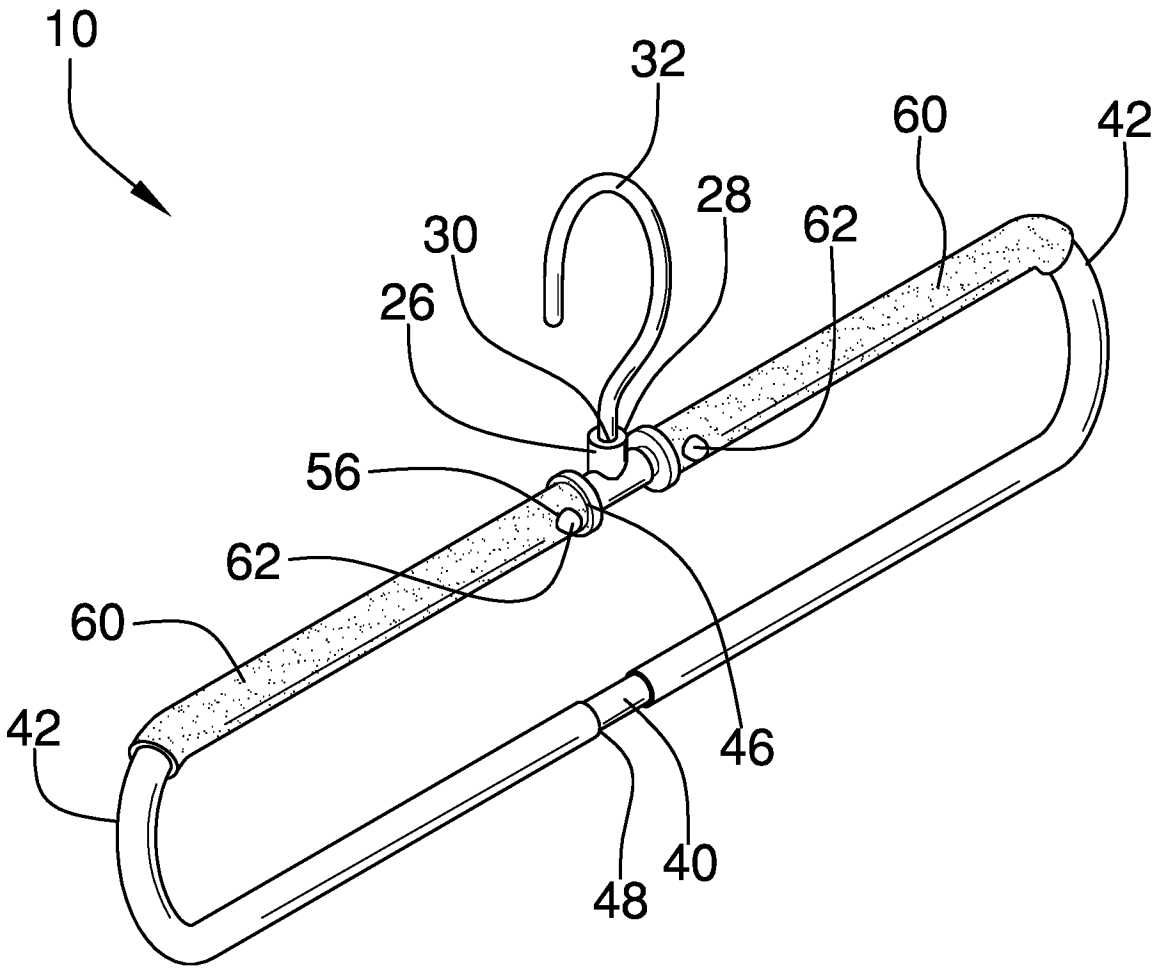
FIG. 1 is a front perspective view of an adjustable clothes hanger assembly according to an embodiment of the disclosure.
Figure 2:
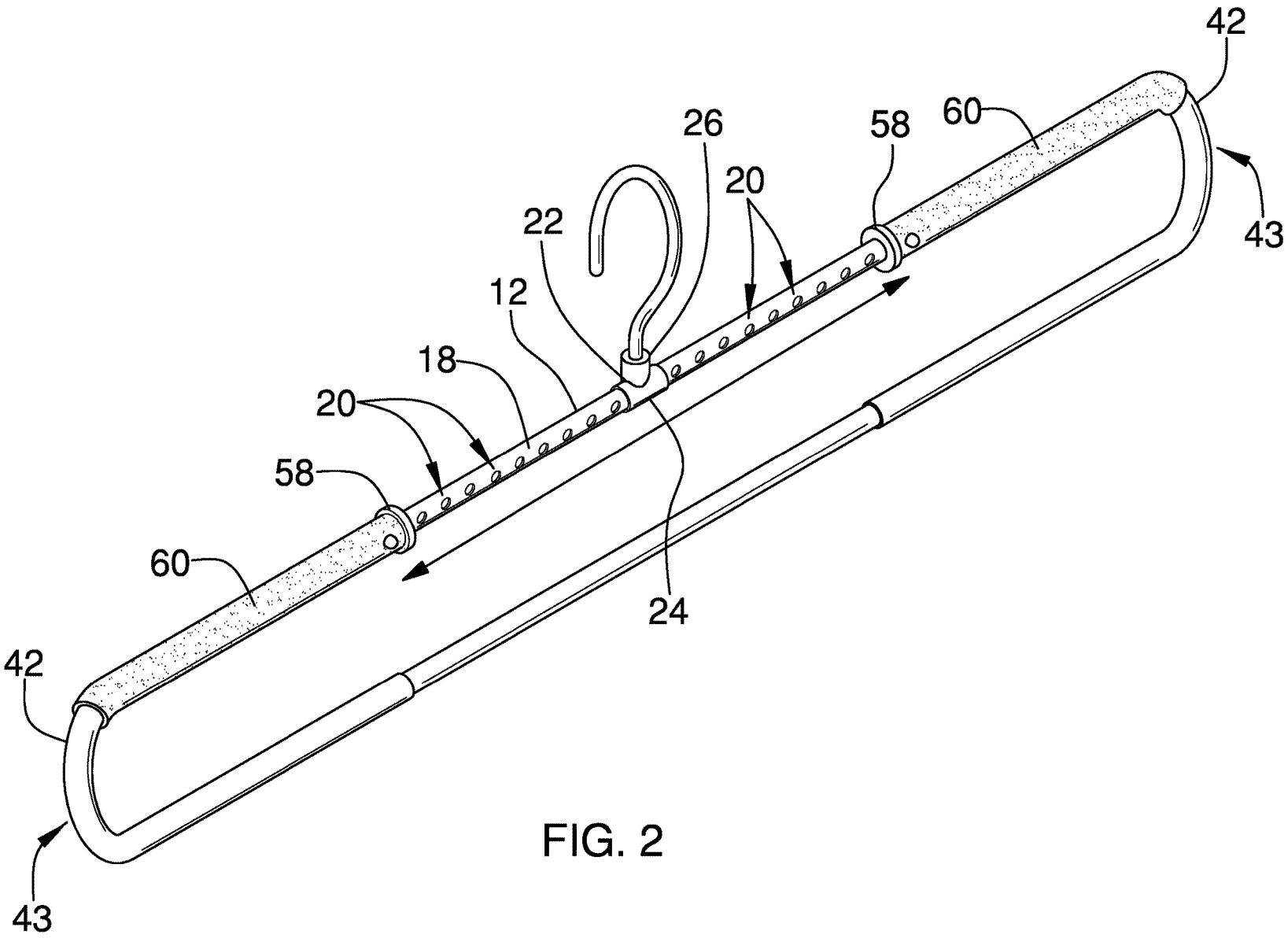
FIG. 2 is a front perspective view of an embodiment of the disclosure showing a pair of curved members being slid outwardly on an upper member and a lower member.
Figure 4:
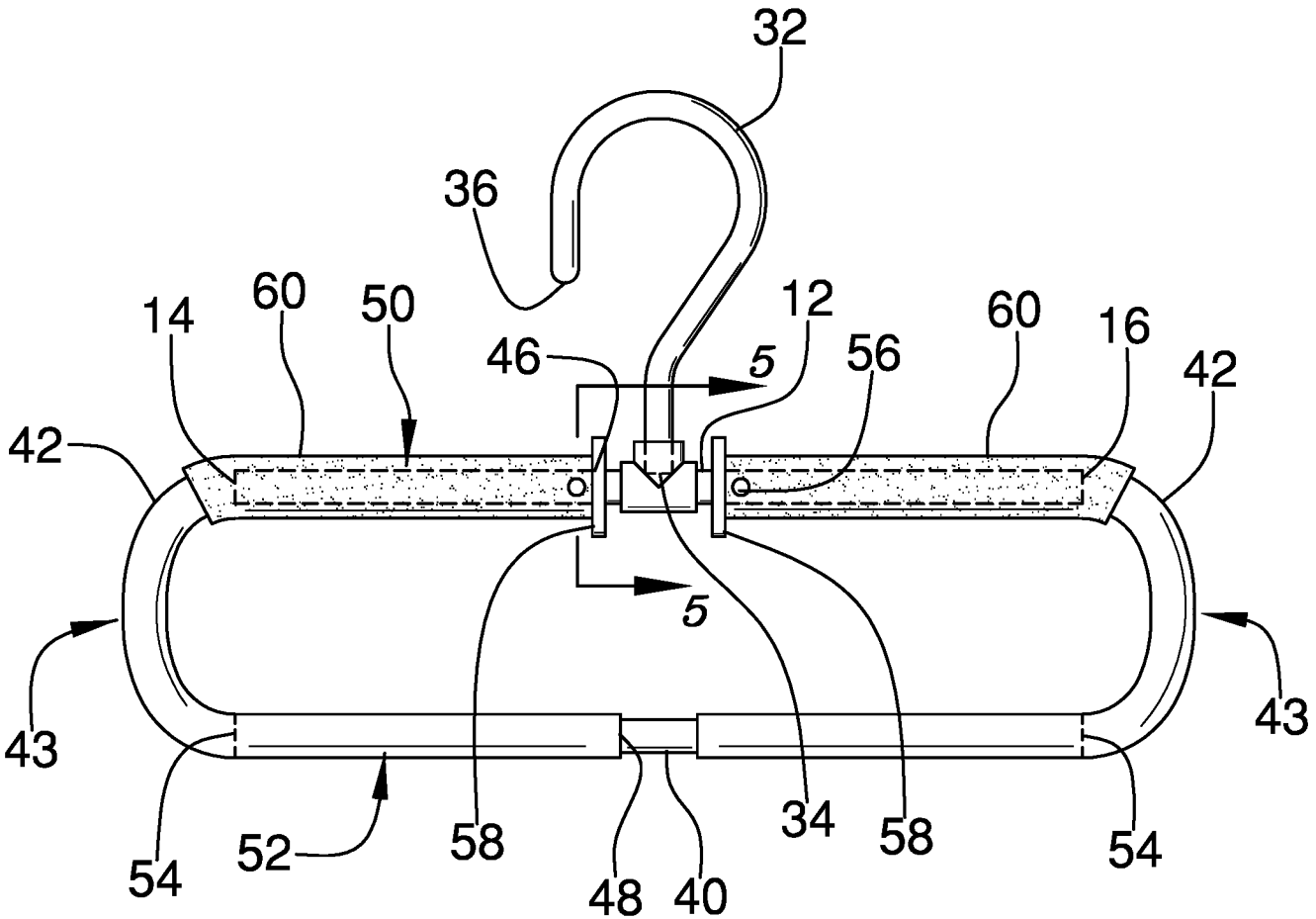
FIG. 4 is a front view of an embodiment of the disclosure.
Figure 3:
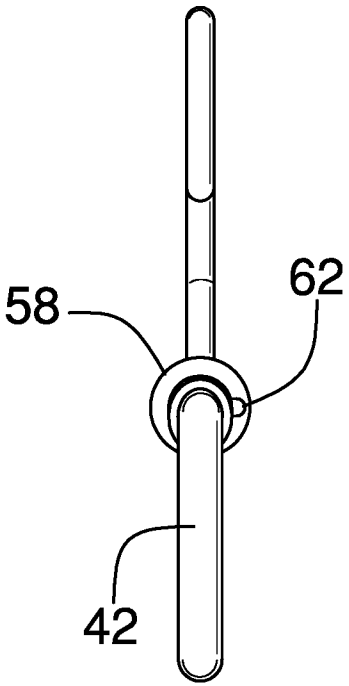
FIG. 3 is a right side view of an embodiment of the disclosure.
Figure 5:
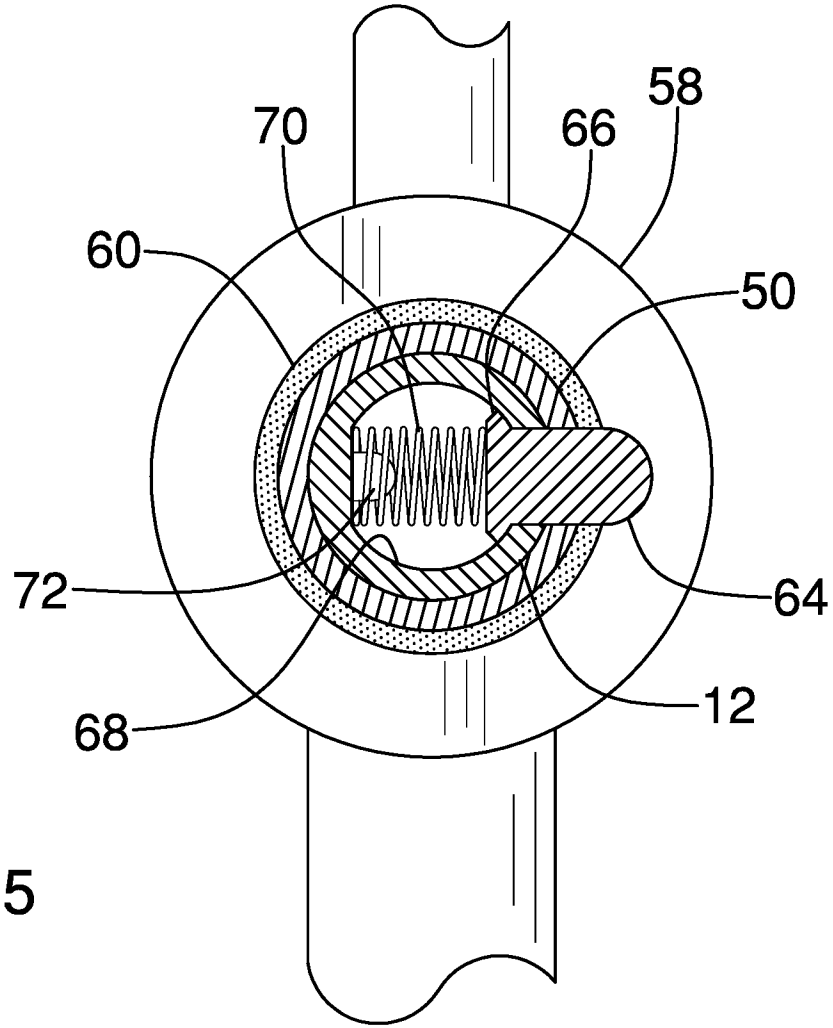
FIG. 5 is a cross sectional view taken along line 5-5 of FIG. 4 of an embodiment of the disclosure.
Figure 6:
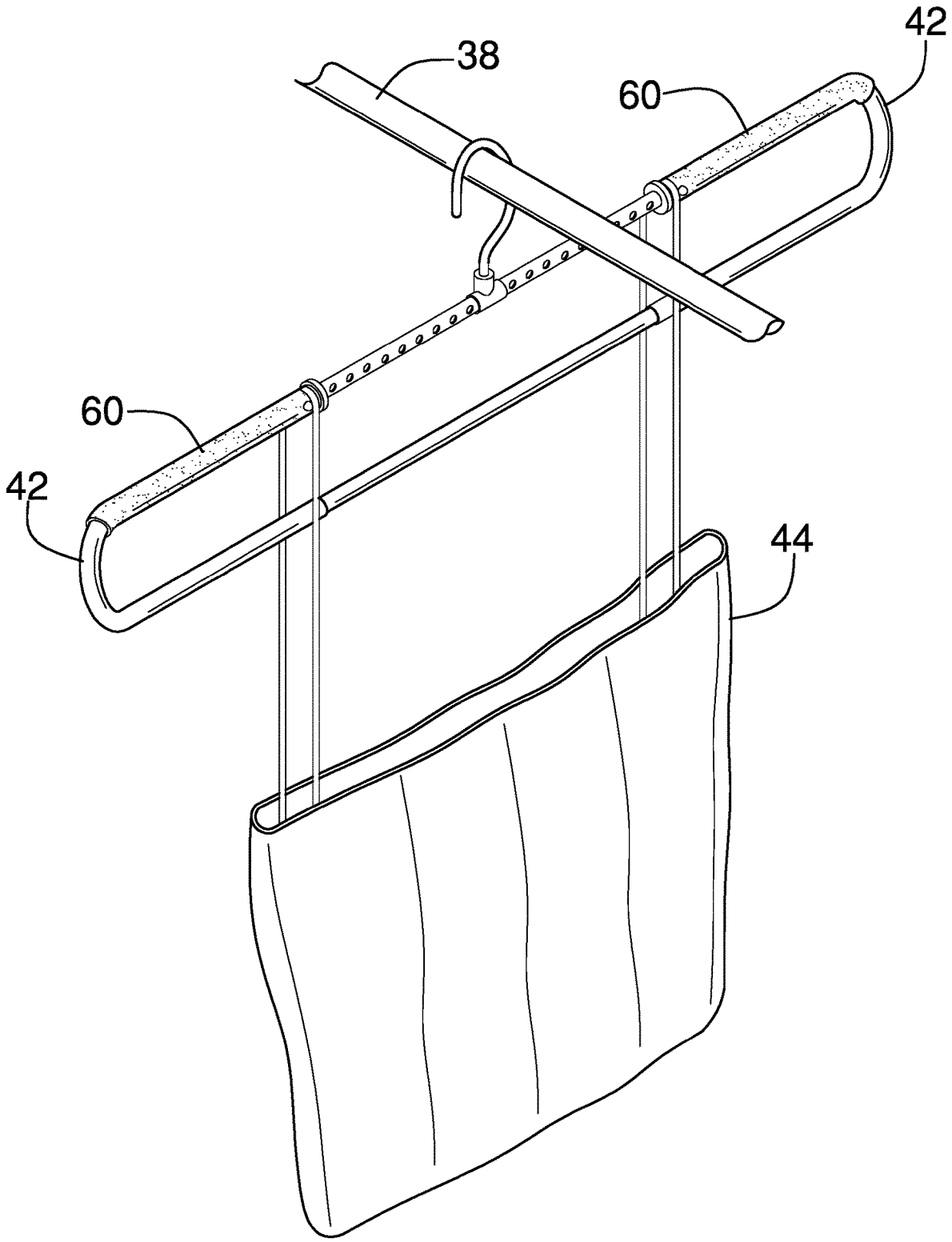
FIG. 6 is a perspective in-use view of an embodiment of the disclosure.

With reference now to the drawings, and in particular to FIGS. 1 through 10 thereof, a new clothes hanger device embodying the principles and concepts of an embodiment of the disclosure and generally designated by the reference numeral 10 will be described.

As best illustrated in FIGS. 1 through 10, the adjustable clothes hanger assembly 10 generally comprises an upper member 12 that has a first end 14, a second end 16 and an outer wall 18 extending between the first end 14 and the second end 16. The upper member 12 has a plurality of holes 20 each extending through the outer wall 18 of the upper member 12 and the plurality of holes 20 is spaced apart from each other and is evenly distributed between the first end 14 and the second end 16. A receiver 22 has a first portion 24 that is perpendicularly oriented with a second portion 26. The first portion 24 extends around the outer wall 18 of the upper member 12 at a point is centrally located between the first end 14 and the second end 16 having the second portion 26 extending away from the upper member 12. The second portion 26 has a distal end 28 with respect to the first portion 24 and the distal end 28 has a well 30 extending into the second portion 26.

A hook 32 is coupled to and extends upwardly from the upper member 12 thereby facilitating the hook 32 to be positioned on a closet rod. The hook 32 has a lower end 34 and an upper end 36 and the lower end 34 extends into the well 30 in the distal end 28 of the second portion 26 of the receiver 22. Furthermore, the hook 32 is curved between the upper end 36 and the lower end 34 such that the upper end 36 is directed toward the lower end 34 thereby facilitating the hook 32 to extend around the closet rod 38. A lower member 40 is included that is elongated to have a length which is equal to a length of the upper member 12.

A pair of curved tubes 42 is provided and each of the curved tubes 42 has a centrally located curve 43 such that each of the curved tubes 42 defines a U-shape. In this way the upper member 12, the lower member 40 and the pair of curved tubes 42 can hang an article of clothing 44 in the convention of a clothes hanger. Each of the curved tubes 42 insertably receives the upper member 12 and the lower member 40 such that the upper member 12, the lower member 40 and the pair of curved tubes 42 defines an ovoid shape which has an adjustable length to accommodate various sizes of articles of clothing 44. Additionally, each of the upper member 12, the lower member 40 and the pair of curved tubes 42 may be comprised of steel, aluminum or other type of non plastic material that is recyclable.

Each of the curved tubes 42 has a primary end 46 and a secondary end 48 and the curve 43 associated with each of the curved tubes 42 is centrally located between the primary end 46 and the secondary end 48. Thus, the curve 43 defines a primary portion 50 of the curved tubes 42 that is spaced from and is oriented parallel with a secondary portion 52 of the curved tubes 42. The primary end 46 of each of the curved tubes 42 insertably receives a respective one of the first end 14 and the second end 16 of the upper member 12. The secondary end 48 of each of the curved tubes 42 insertably receives a respective one of a pair of ends 54 of the lower member 40. Additionally, each of the curved tubes 42 has a hole 56 extending through the primary portion 50 and the hole 56 in each of the curved tubes 42 is positioned adjacent to the primary end 46 of a respective one of the curved tubes 42.

A pair of washers 58 is each attached to the primary end 46 of a respective one of the curved tubes 42 such that the upper member 12 extends through each of the washers 58. Each of the washers 58 has a diameter that is greater than a diameter of the respective curved tube 42. A pair of cushions 60 is each wrapped around a respective one of the curved tubes 42 to facilitate the article of clothing 44 to frictionally engage the cushions 60 thereby inhibiting the article of clothing 44 from sliding off of the curved tubes 42. Each of the cushions 60 is positioned on the primary portion 50 of the respective curved tube 42 and each of the cushions 60 extends between a respective one of the washers 58 and the curve 43 in the respective curved tube 42.

A pair of locks 62 is each movably integrated into the upper member 12 and each of the locks 62 is biased to extend outwardly through a respective one of the holes in the outer wall 18 of the upper member 12. Each of the locks 62 is biased to extend outwardly through the hole in the primary portion 50 of a respective one of the curved tubes 42 for retaining the pair of curved tubes 42 a selected distance apart from each other. In this way the length of the ovoid shape defined by the upper member 12, the lower member 40 and the pair of curved tubes 42 can be adjusted.

Each of the locks 62 comprises a button 64 that has a lip 66 extending around the button 64. The lip 66 abuts an interior surface 68 of the upper member 12 thereby inhibiting the button 64 from being removed from the upper member 12. Each of the locks 62 includes a biasing member 70 that is positioned within the upper member 12 and the biasing member 70 extends between the interior surface 68 of the upper member 12 and the lip 66 on the button 64. Additionally, the biasing member 70 extends around an engagement point 72 that is disposed on the interior surface 68 of the upper member 12 thereby inhibiting the biasing member 70 from being displaced.

In an alternative embodiment 74 shown in FIGS. 7 through 10, a panel 76 is provided which has an outer edge 78, a rear surface 80 and a front surface 81. The outer edge 78 has a first top side 82, a second top side 84, a third top side 86 and a bottom side 88. Each of the first top side 82 and the second top side 84 angles upwardly from the bottom side 88 and intersects the third top side 86 such that the panel 76 has a triangular shape. Additionally, the third top side 86 extends along a line is oriented parallel with the bottom side 88 and the lower end 34 of the hook 32 is attached to the third top side 86.

Figure 8:
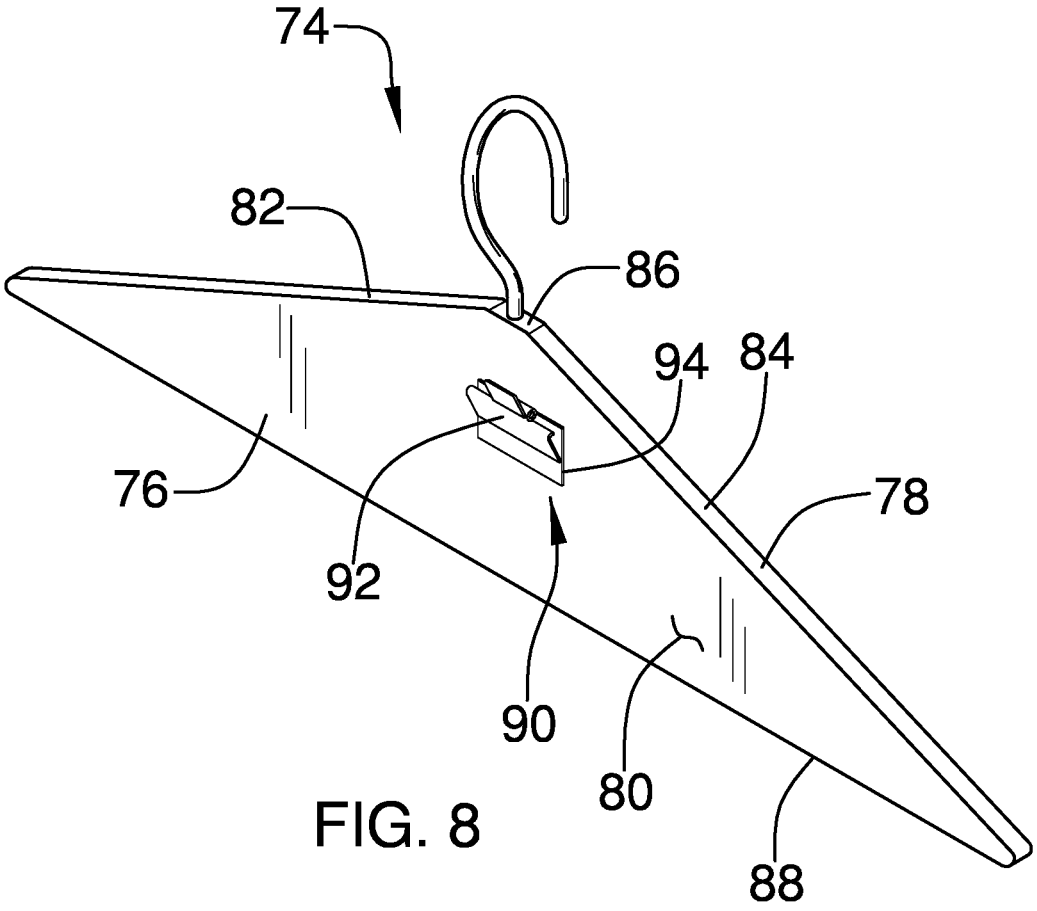
FIG. 8 is a back perspective view of an alternative embodiment of the disclosure.
Figure 10:
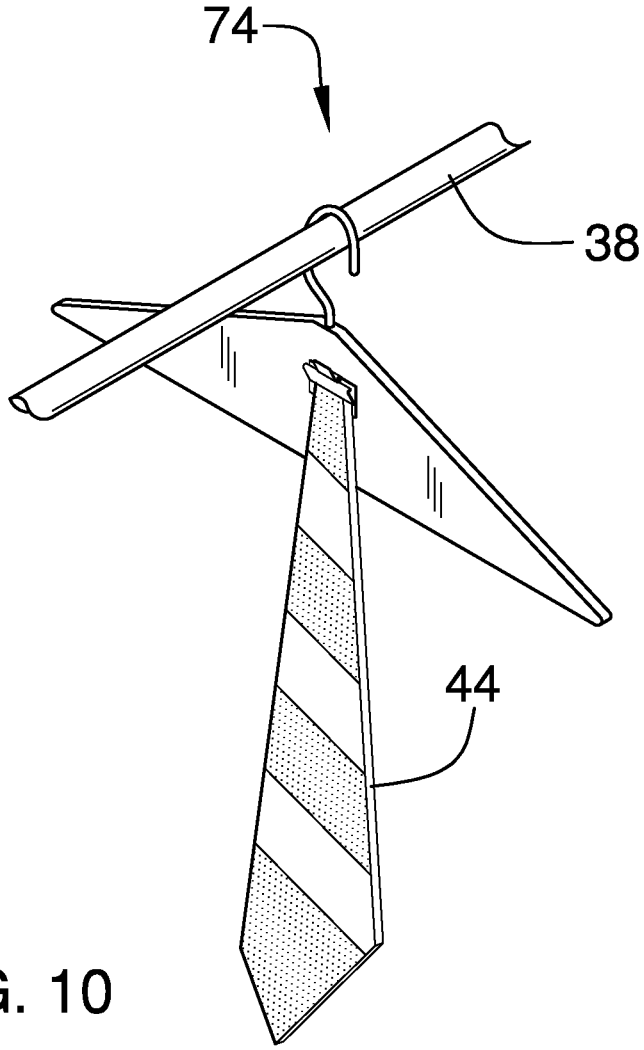
FIG. 10 is a perspective view of an alternative embodiment of the disclosure.

As is shown in FIGS. 8 and 10, the alternative embodiment 74 includes a first clip 90 that includes a first jaw 92 which is pivotally attached to a second jaw 94. The first clip 90 is biased into a closed position having the first jaw 92 being positioned against the second jaw 94. The second jaw 94 is coupled to the rear surface 80 of the panel 76. Additionally, the first clip 90 is urgeable into an open position having the first jaw 92 being spaced from the second jaw 94 thereby facilitating an article of clothing 44 to be positioned between the first jaw 92 and the second jaw 94. In this way the article of clothing 44 is compressed between the first jaw 92 and the second jaw 94 when the first clip 90 is biased into the closed position. As is most clearly shown in FIG. 10, the article of clothing 44 may be a necktie.

Figure 7:
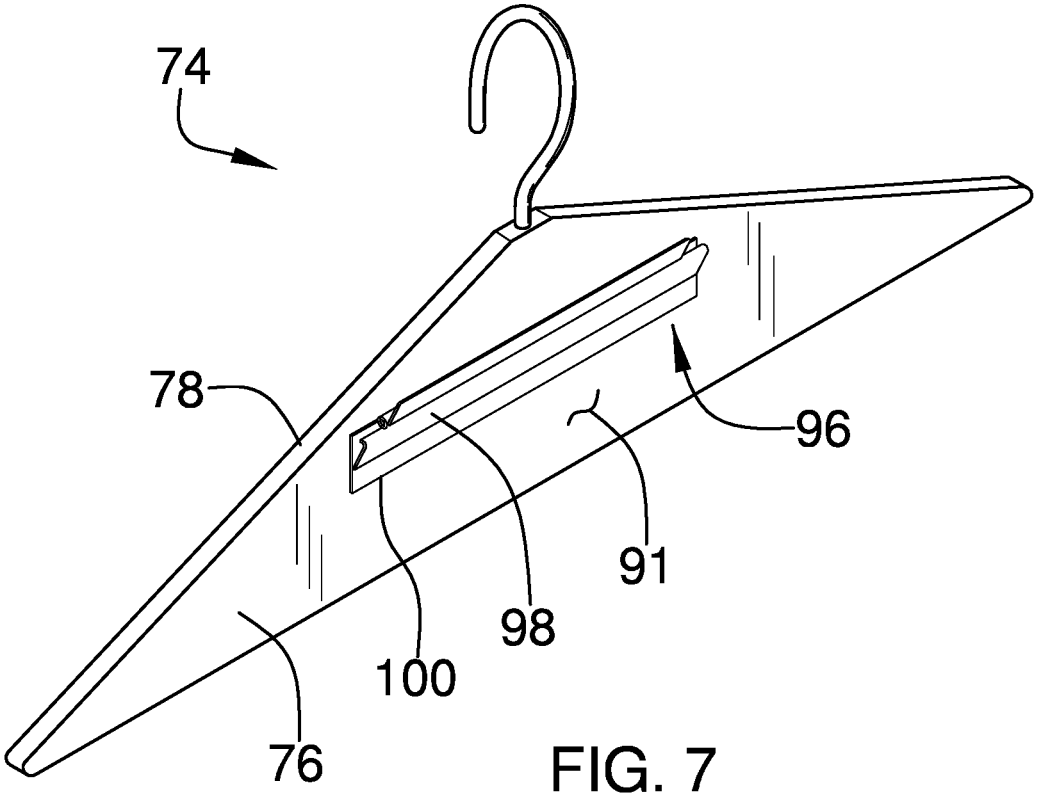
FIG. 7 is a front perspective view of an alternative embodiment of the disclosure.
Figure 9:
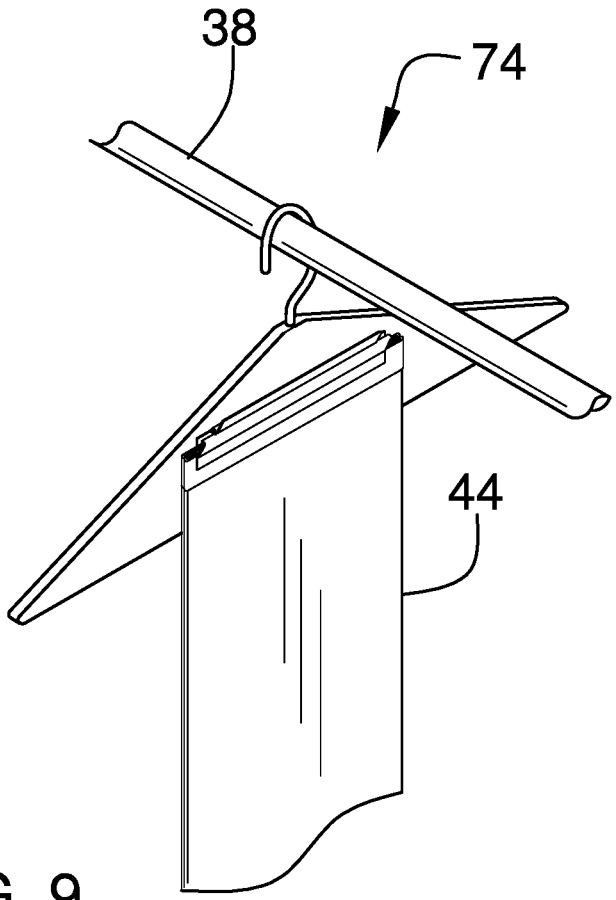
FIG. 9 is a top perspective view of an alternative embodiment of the disclosure.

As is shown in FIGS. 7 and 9, the alternative embodiment 74 includes a second clip 96 which comprises a primary jaw 98 that is pivotally attached to a secondary jaw 100. The second clip 96 is biased into a closed position having the primary jaw 98 being positioned against the secondary jaw 100. The secondary jaw 100 is coupled to the front surface 91 of the panel 76. The second clip 96 is urgeable into an open position having the secondary jaw 100 being spaced from the secondary jaw 100 thereby facilitating the article of clothing 44 to be positioned between the secondary jaw 100 and the secondary jaw 100. In this way the article of clothing 44 is compressed between the secondary jaw 100 and the secondary jaw 100 when the second clip 96 is biased into the closed position. Furthermore, the second clip 96 has a length that is greater than the length of the first clip 90 such that, as is most clearly shown in FIG. 9, the second clip 96 can engage a pair of pants.

In use, each of the locks 62 is pushed inwardly to facilitate the pair of curved tubes 42 to be adjusted on the upper member 12 and the lower member 40. The locks 62 are released to facilitate the locks 62 extend outwardly through a respective one of the holes 20 in the upper member 12 and the hole 56 in the respective curved tube 42 to accommodate the article of clothing 44 that is hung on the primary portion 50 of the pair of curved tubes 42. In this way various sizes of articles of clothing can be hung on the primary portion 50 of the pair of curved tubes 42.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An adjustable clothes hanger assembly for accommodating various sizes of clothing, said assembly comprising:

an upper member being longitudinally elongated;

a hook being coupled to and extending upwardly from said upper member thereby facilitating said hook to be positioned on a closet rod;

a lower member being elongated to have a length being equal to a length of said upper member;

a pair of curved tubes, each of said curved tubes having a centrally located curve such that each of said curved tubes defines a U-shape wherein said upper member and said lower member and said pair of curved tubes is configured to hang an article of clothing in the convention of a clothes hanger, each of said curved tubes insertably receiving said upper member and said lower member such that said upper member and said lower member and said pair of curved tubes defines an ovoid shape which has an adjustable length wherein said upper member and said lower member said pair of curved tubes is configured to accommodate various sizes of articles of clothing;

wherein said upper member has a first end, a second end and an outer wall extending between said first end and said second end, said upper member having a plurality of holes each extending through said outer wall of said upper member, said plurality of holes being spaced apart from each other and being evenly distributed between said first end and said second end; and a receiver having a first portion being perpendicularly oriented with a second portion, said first portion extending around said outer wall of said upper member at a point being centrally located between said first end and said second end having said second portion extending away from said upper member, said second portion having a distal end with respect to said first portion, said distal end having a well extending into said second portion.

2. The assembly according to claim 1, wherein said hook has a lower end and an upper end, said lower end extending into said well in said distal end of said second portion of said receiver, said hook being curved between said upper end and said lower end such that said upper end is directed toward said lower end thereby facilitating said hook to extend around the closet rod.

3. An adjustable clothes hanger assembly for accommodating various sizes of clothing, said assembly comprising:

an upper member being longitudinally elongated;

a hook being coupled to and extending upwardly from said upper member thereby facilitating said hook to be positioned on a closet rod;

a lower member being elongated to have a length being equal to a length of said upper member;

a pair of curved tubes, each of said curved tubes having a centrally located curve such that each of said curved tubes defines a U-shape wherein said upper member and said lower member and said pair of curved tubes is configured to hang an article of clothing in the convention of a clothes hanger, each of said curved tubes insertably receiving said upper member and said lower member such that said upper member and said lower member and said pair of curved tubes defines an ovoid shape which has an adjustable length wherein said upper member and said lower member said pair of curved tubes is configured to accommodate various sizes of articles of clothing;

wherein said upper member has a first end, a second end and an outer wall extending between said first end and said second end, said upper member having a plurality of holes each extending through said outer wall of said upper member, said plurality of holes being spaced apart from each other and being evenly distributed between said first end and said second end wherein each of said curved tubes has a primary end and a secondary end, said curve associated with each of said curved tubes being centrally located between said primary end and said secondary end to define a primary portion of said curved tubes being spaced from and being oriented parallel with a secondary portion of said curved tubes;

wherein said primary end of each of said curved tubes insertably receives a respective one of said first end and said second end of said upper member;

wherein said secondary end of each of said curved tubes insertably receives a respective one of a pair of ends of said lower member; and wherein each of said curved tubes has a hole extending through said primary portion, said hole in each of said curved tubes being positioned adjacent to said primary end of a respective one of said curved tubes.

4. The assembly according to claim 3, further comprising a pair of washers, each of said washers being attached to said primary end of a respective one of said curved tubes such that said upper member extends through each of said washers, each of said washers having a diameter being greater than a diameter of said respective curved tube.

5. The assembly according to claim 4, further comprising a pair of cushions, each of said cushions being wrapped around a respective one of said curved tubes wherein each of said cushions is configured to facilitate the article of clothing to frictionally engage said cushions thereby inhibiting the article of clothing from sliding off of said curved tubes, each of said cushions being positioned on said primary portion of said respective curved tube, each of said cushions extending between a respective one of said washers and said curve in said respective curved tube.

6. The assembly according to claim 3, further comprising a pair of locks, each of said locks being movably integrated into said upper member, each of said locks being biased to extend outwardly through a respective one of said holes in said outer wall of said upper member, each of said locks being biased to extend outwardly through said hole in said primary portion of a respective one of said curved tubes for retaining said pair of curved tubes a selected distance apart from each other for adjusting the length of said ovoid shape defined by said upper member and said lower member and said pair of curved tubes.

7. The assembly according to claim 6, wherein each of said locks comprises:

a button having a lip extending around said button, said lip abutting an interior surface of said upper member thereby inhibiting said button from being removed from said upper member; and a biasing member being positioned within said upper member, said biasing member extending between said interior surface of said upper member and said lip on said button, said biasing member extending around an engagement point being disposed on said interior surface of said upper member thereby inhibiting said biasing member from being displaced.

8. An adjustable clothes hanger assembly for accommodating various sizes of clothing, said assembly comprising:

an upper member having a first end, a second end and an outer wall extending between said first end and said second end, said upper member having a plurality of holes each extending through said outer wall of said upper member, said plurality of holes being spaced apart from each other and being evenly distributed between said first end and said second end;

a receiver having a first portion being perpendicularly oriented with a second portion, said first portion extending around said outer wall of said upper member at a point being centrally located between said first end and said second end having said second portion extending away from said upper member, said second portion having a distal end with respect to said first portion, said distal end having a well extending into said second portion;

a hook being coupled to and extending upwardly from said upper member thereby facilitating said hook to be positioned on a closet rod, said hook having a lower end and an upper end, said lower end extending into said well in said distal end of said second portion of said receiver, said hook being curved between said upper end and said lower end such that said upper end is directed toward said lower end thereby facilitating said hook to extend around the closet rod;

a lower member being elongated to have a length being equal to a length of said upper member;

a pair of curved tubes, each of said curved tubes having a centrally located curve such that each of said curved tubes defines a U-shape wherein said upper member and said lower member and said pair of curved tubes is configured to hang an article of clothing in the convention of a clothes hanger, each of said curved tubes insertably receiving said upper member and said lower member such that said upper member and said lower member and said pair of curved tubes defines an ovoid shape which has an adjustable length wherein said upper member and said lower member said pair of curved tubes is configured to accommodate various sizes of articles of clothing, each of said curved tubes having a primary end and a secondary end, said curve associated with each of said curved tubes being centrally located between said primary end and said secondary end to define a primary portion of said curved tubes being spaced from and being oriented parallel with a secondary portion of said curved tubes, said primary end of each of said curved tubes insertably receiving a respective one of said first end and said second end of said upper member, said secondary end of each of said curved tubes insertably receiving a respective one of a pair of ends of said lower member, each of said curved tubes having a hole extending through said primary portion, said hole in each of said curved tubes being positioned adjacent to said primary end of a respective one of said curved tubes;

a pair of washers, each of said washers being attached to said primary end of a respective one of said curved tubes such that said upper member extends through each of said washers, each of said washers having a diameter being greater than a diameter of said respective curved tube;

a pair of cushions, each of said cushions being wrapped around a respective one of said curved tubes wherein each of said cushions is configured to facilitate the article of clothing to frictionally engage said cushions thereby inhibiting the article of clothing from sliding off of said curved tubes, each of said cushions being positioned on said primary portion of said respective curved tube, each of said cushions extending between a respective one of said washers and said curve in said respective curved tube;

a pair of locks, each of said locks being movably integrated into said upper member, each of said locks being biased to extend outwardly through a respective one of said holes in said outer wall of said upper member, each of said locks being biased to extend outwardly through said hole in said primary portion of a respective one of said curved tubes for retaining said pair of curved tubes a selected distance apart from each other for adjusting the length of said ovoid shape defined by said upper member and said lower member and said pair of curved tubes, each of said locks comprising:

a button having a lip extending around said button, said lip abutting an interior surface of said upper member thereby inhibiting said button from being removed from said upper member; and a biasing member being positioned within said upper member, said biasing member extending between said interior surface of said upper member and said lip on said button, said biasing member extending around an engagement point being disposed on said interior surface of said upper member thereby inhibiting said biasing member from being displaced.

* * * * *